United States Patent [19]

Panneri et al.

[11] Patent Number: 5,063,803

[45] Date of Patent: Nov. 12, 1991

[54] TAPE CUTTING AND DISPENSING MACHINE

[75] Inventors: Alfred J. Panneri, Cheektowaga; Louis Terragnoli, Williamsville, both of N.Y.

[73] Assignee: A. J. Panneri Enterprises, Inc., Buffalo, N.Y.

[21] Appl. No.: 560,101

[22] Filed: Jul. 31, 1990

[51] Int. Cl.[5] ..... B65B 13/04

[52] U.S. Cl. ..... 83/203; 53/586; 53/592; 83/436; 83/577; 83/590; 271/313; 271/900

[58] Field of Search ..... 271/312, 313, 307, 900; 53/583, 586, 590, 592, 399; 83/590, 589, 586, 587, 588, 575, 577, 582, 584, 436, 449, 203

[56] References Cited

U.S. PATENT DOCUMENTS

| | | | |
|---|---|---|---|
| 1,949,544 | 3/1934 | Matson | 28/21 |
| 2,865,153 | 12/1958 | Seragnoli | 53/34 |
| 3,000,151 | 9/1961 | Winkler et al. | 53/3 |
| 3,021,653 | 2/1962 | Marshall | 53/74 |
| 3,191,831 | 6/1965 | Bunting, Jr. et al. | 83/587 X |
| 3,283,634 | 11/1966 | Lodjic | 83/33 X |
| 3,340,882 | 9/1967 | Holmes et al. | 133/1 |
| 3,518,806 | 7/1970 | Davidson et al. | 53/59 |
| 3,854,356 | 12/1974 | Okreglak | 83/587 X |
| 3,891,206 | 6/1975 | Bar-on | 271/313 |
| 4,119,307 | 10/1978 | Hamaker | 271/313 |
| 4,276,736 | 7/1981 | Haberstroh et al. | 53/399 |
| 4,516,461 | 5/1985 | Schaeffer | 83/563 X |
| 4,617,784 | 10/1986 | Golicz et al. | 53/540 |
| 4,739,605 | 4/1988 | Takamura | 53/399 |
| 4,852,329 | 8/1989 | Terragnoli | 53/399 |

FOREIGN PATENT DOCUMENTS

| | | | |
|---|---|---|---|
| 18604 | 8/1956 | Fed. Rep. of Germany | 53/ |

*Primary Examiner*—Mark Rosenbaum
*Assistant Examiner*—Kenneth E. Peterson
*Attorney, Agent, or Firm*—Joseph P. Gastel

[57] ABSTRACT

A tape cutting and dispensing machine including upper and lower plastic blocks held between spaced frame members, a recess in one block containing a drive roll and a recess in the other block containing a nip roll, mechanism effectively mounted relative to the frame members for selectively moving the nip roll toward and away from the drive roll, flexible lips adjacent the drive roll and nip roll for guiding a tape beyond the rolls, a guillotine blade arrangement mounted on the blocks, mechanism for selectively manually retracting a movable guillotine blade from its normal overlying relationship relative to a fixed blade, a drive motor for selectively driving the drive roll, a solenoid for selectively actuating the guillotine blade, and a table having a depression therein mounted at the output side of the machine for permitting the central portion of a severed end of the tape to be pressed into it by a bundle being taped and having a surface adjacent the depression against which the tape ends can be pressed together.

36 Claims, 6 Drawing Sheets

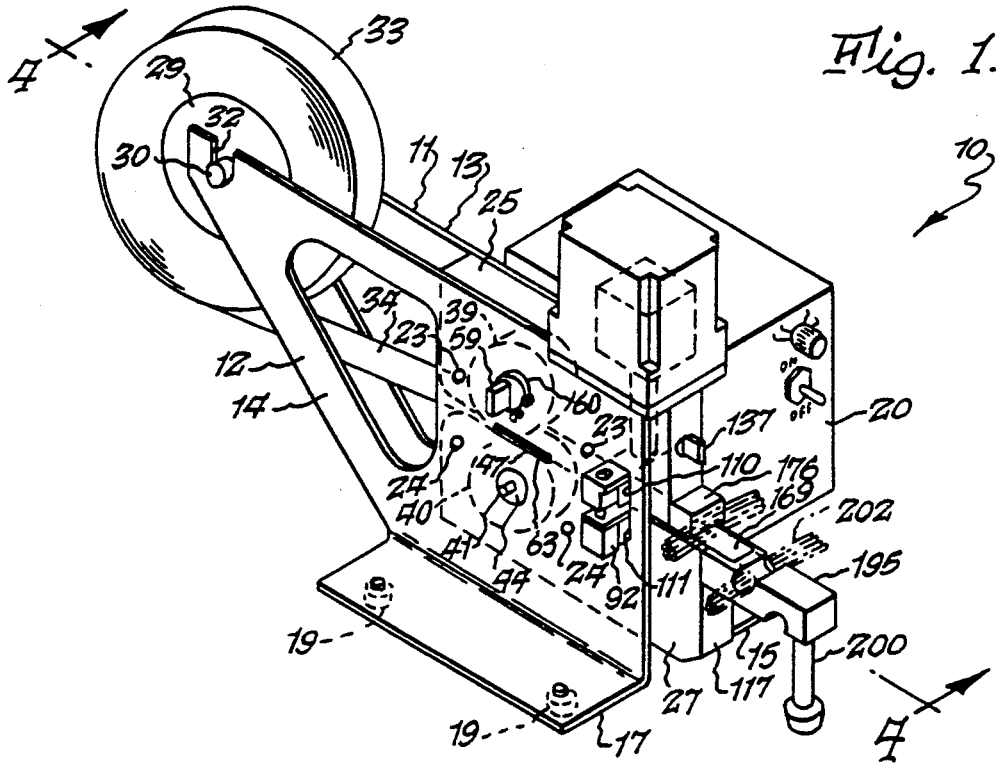
Fig. 1.
Fig. 2.
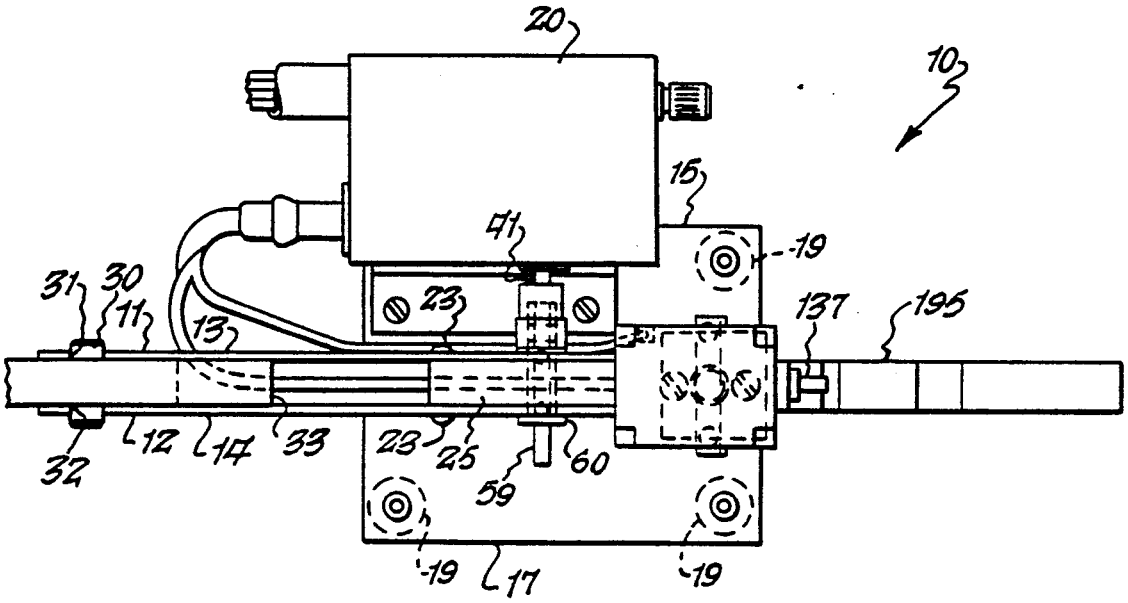

Fig. 3.
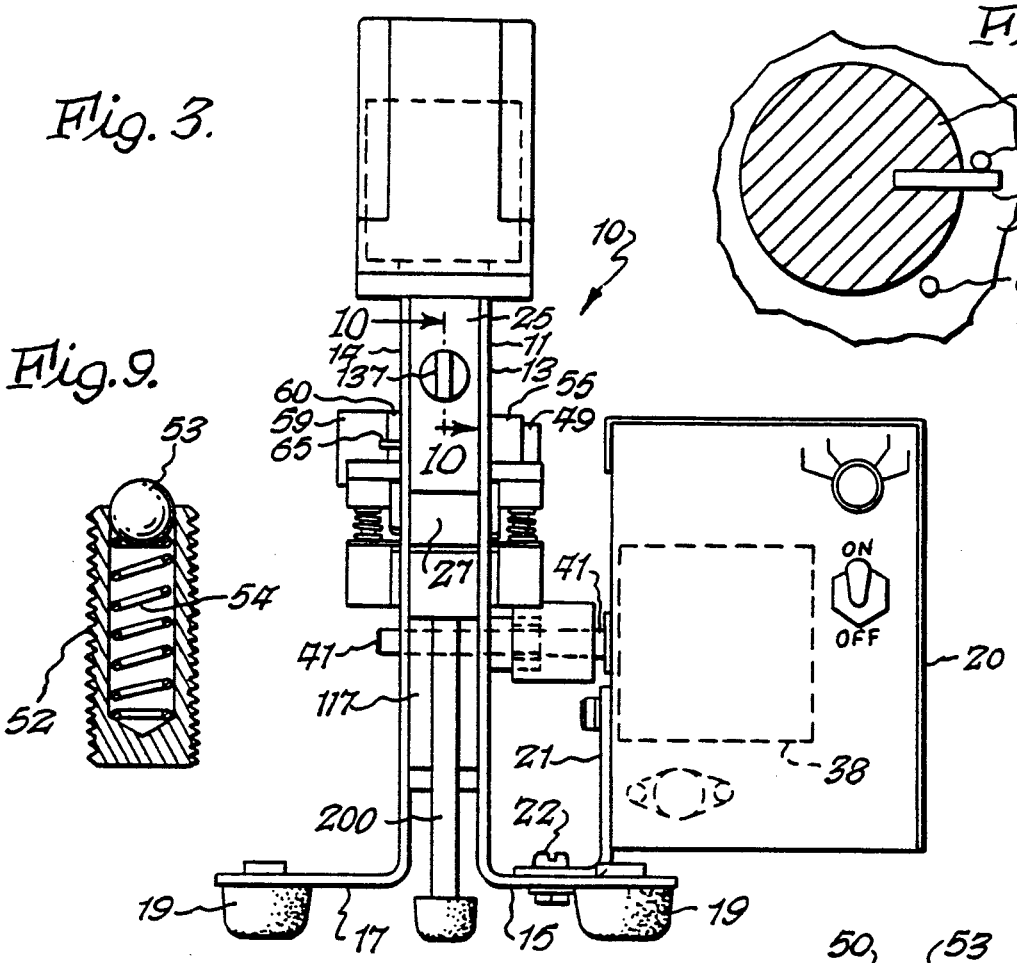
Fig. 6.
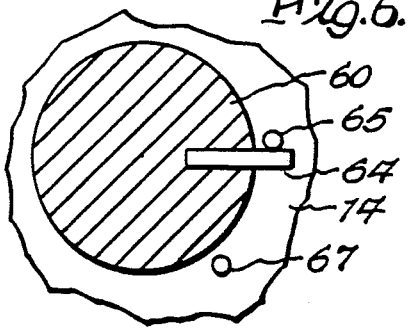
Fig. 9.
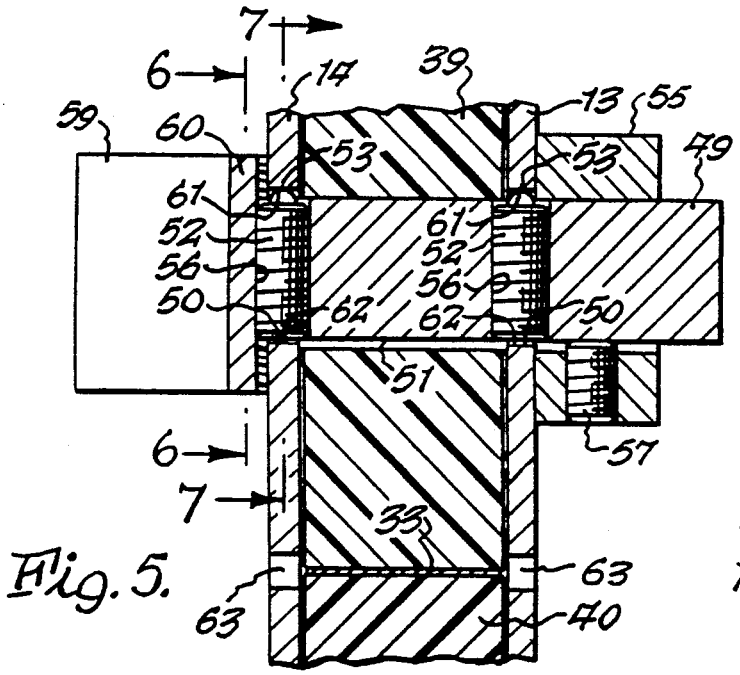
Fig. 5.
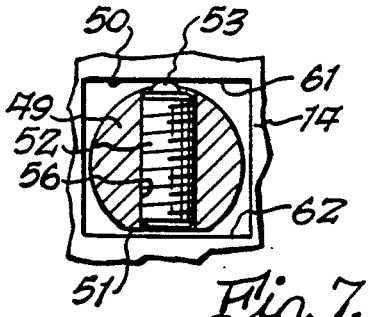
Fig. 7.
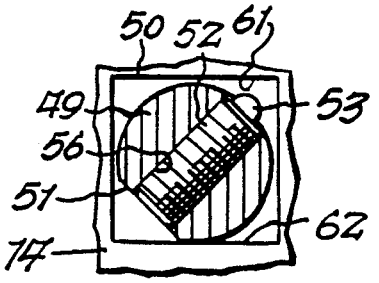
Fig. 8.

Fig. 4A.
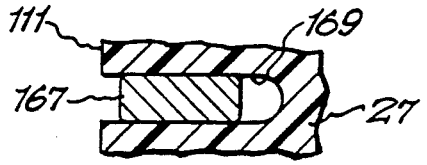
Fig. 4B.
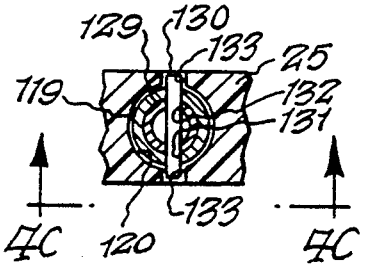
Fig. 4D.
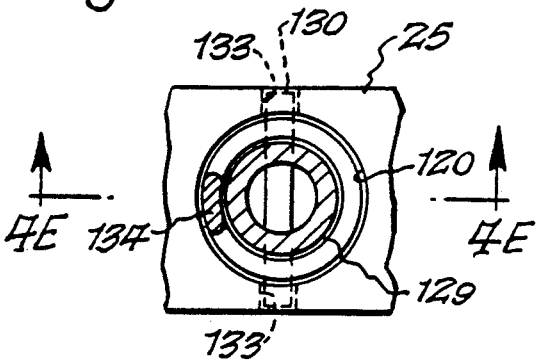
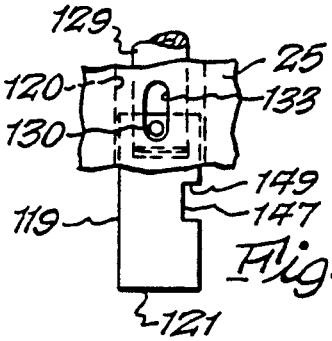
Fig. 4C.
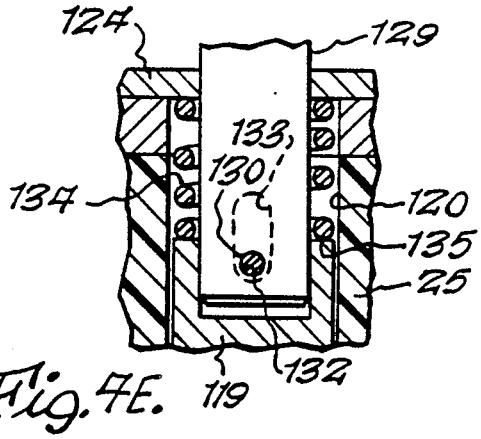
Fig. 4E.
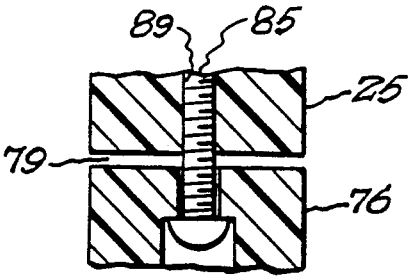
Fig. 4F.
Fig. 13A.
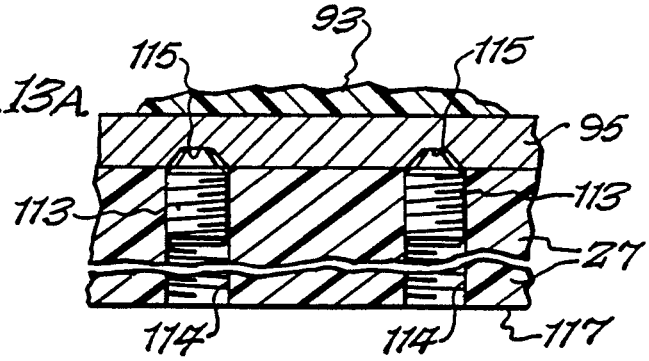

Fig. 17.
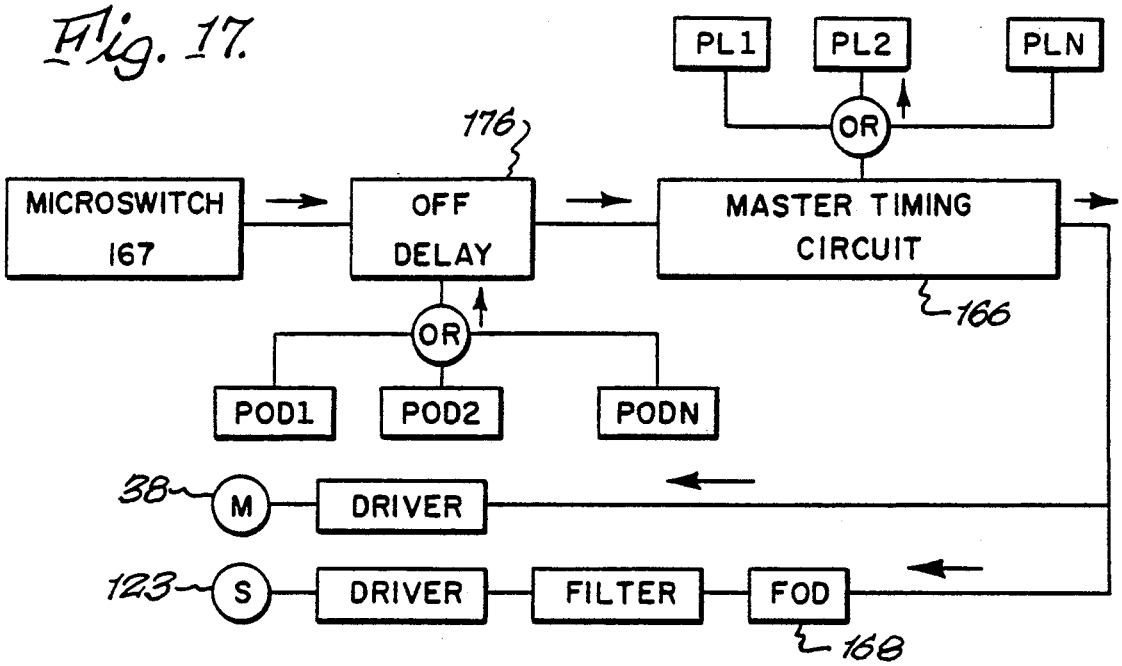
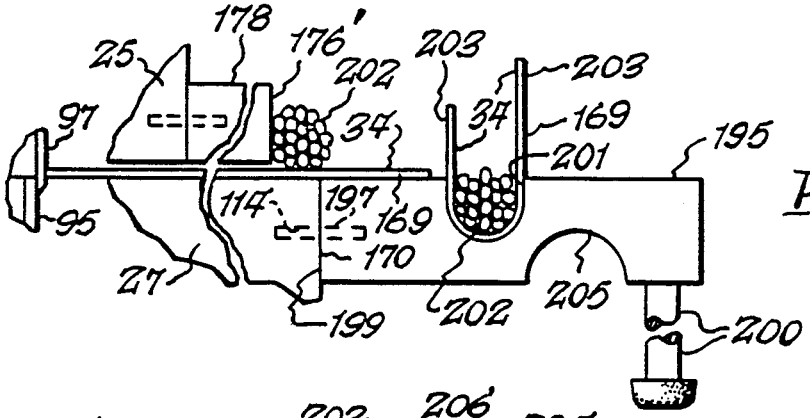
Fig. 18.
Fig. 19.
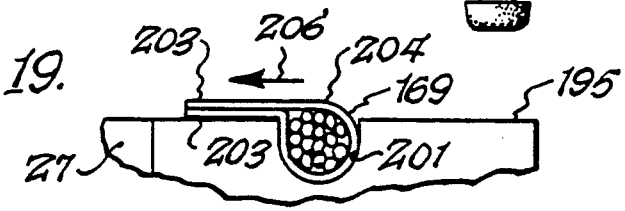
Fig. 20.
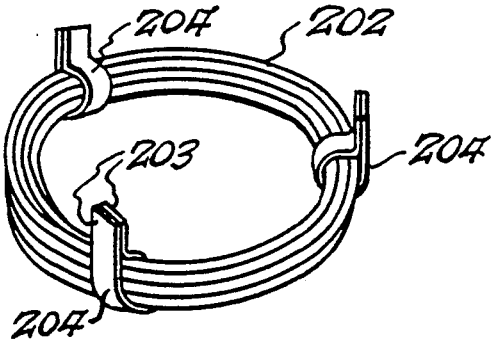

TAPE CUTTING AND DISPENSING MACHINE

BACKGROUND OF THE INVENTION

The present invention relates to an improved tape cutting and dispensing machine for automatically cutting and dispensing a predetermined length of tape from a tape roll.

SUMMARY OF THE INVENTION

It is one object of the present invention to provide a tape cutting and dispensing machine in which the main body components are a pair of blocks mounted between spaced frame members.

Another object of the present invention is to provide a tape cutting and dispensing machine as described in the preceding object which includes an unique arrangement for selectively manually moving a nip roll away from a drive-roll to permit a tape to be threaded therebetween.

A further object of the present invention is to provide an improved tape cutting and dispensing machine having an unique lip arrangement associated with the drive and nip rolls for guiding a tape in a predetermined path as it leaves the nip between the rolls.

Yet another object of the present invention is to provide a tape cutting and dispensing machine which has an unique arrangement for mounting cutting blades thereon.

A still further object of the present invention is to provide an improved tape cutting and dispensing machine which has an unique arrangement for selectively manually retracting a movable blade from its normal overlying relationship to a stationary blade to thereby permit threading of a tape therebetween.

Yet another object of the present invention is to provide an improved tape cutting and dispensing machine which has an improved guide arrangement for guiding the free end of a tape to knives during the threading of a tape into the machine.

A still further object of the present invention is to provide an unique attachment for a tape cutting and dispensing machine which permits a severed predetermined length of tape to be wound around a bundle of objects in an extremely simple and efficient manner. Other objects and attendant advantages of the present invention will readily be perceived hereafter.

The present invention relates to a tape cutting and dispensing machine comprising a frame, opposite sheet-like frame sides on said frame, first and second spacer blocks having opposite sides, means connecting said sheet-like frame sides to said opposite sides of said first and second spacer blocks, a tape channel between said first and second spacer blocks, tape roll mounting means for mounting a roll of tape relative to said spacer blocks, first and second recesses in said first and second spacer blocks, respectively, a drive roll, a nip roll, means mounting said drive roll for rotation in said first recess of said first spacer block, a nip roll shaft mounting said nip roll and having opposite ends mounted relative to said frame sides for positioning said nip roll in said second recess of said second spacer block in opposition to said drive roll to define a tape path therebetween in substantial alignment with said tape channel, knife means, means mounting said knife means relative to said frame on the opposite side of said drive roll and said nip roll from said tape roll mounting means, first motor means for selectively actuating said knife means to sever a portion of said tape from said roll, and second motor means for selectively driving said drive roll to advance a portion of said tape through said tape channel. In addition, the present invention relates to structure for achieving the above enumerated objects.

The various aspects of the present invention will be more fully understood when the following portions of the specification are read in conjunction with the accompanying drawings wherein:

BRIEF DESCRIPTION OF THE DRAWINGS

FIG. 1 is a perspective view of the tape cutting and dispensing machine of the present invention;

FIG. 2 is an enlarged fragmentary plan view of the machine of FIG. 1;

FIG. 3 is an enlarged end elevational view taken from the right of FIG. 1;

FIG. 4A is a fragmentary cross sectional view taken substantially along line 4A—4A of FIG. 4 and showing the microswitch in the lower spacer block;

FIG. 4B is a fragmentary cross sectional view taken substantially along line 4B—4B of FIG. 4;

FIG. 4C is a fragmentary view taken substantially in the direction of arrows 4C—4C of FIG. 4B;

FIG. 4D is a fragmentary cross sectional view taken substantially along line 4D—4D of FIG. 4;

FIG. 4E is a fragmentary cross sectional view taken substantially along line 4E—4E of FIG. 4D;

FIG. 4F is a fragmentary cross sectional view taken substantially along line 4F—4F of FIG. 4;

FIG. 5 is an enlarged fragmentary cross sectional view taken substantially along line 5—5 of FIG. 4 and showing the structure for moving the nip roll toward and away from the drive roll;

FIG. 6 is a fragmentary cross sectional view taken substantially along line 6—6 of FIG. 5 and showing the structure for defining the limits of movement of the nip roll shaft;

FIG. 7 is a fragmentary cross sectional view taken substantially along line 7—7 of FIG. 5 and showing the nip roll shaft and associated structure in a tape-driving position;

FIG. 8 is a view similar to FIG. 7 but showing the nip roll shaft in a position for permitting a tape to be threaded between the nip roll and drive roll;

FIG. 9 is an enlarged cross sectional view of the detents associated with the nip roll shaft;

FIG. 13A is a fragmentary cross sectional view taken substantially along line 13A—13A of FIG. 13;

FIG. 17 is a schematic electrical diagram of the machine;

FIG. 18 is a fragmentary enlarged side elevational view of the attachment to the machine for taping a tube coil;

FIG. 19 is a schematic view showing how the attachment of FIG. 18 is used; and

FIG. 20 is a perspective view of a coil of tubing having the cut tapes produced by the machine applied thereto.

DESCRIPTION OF THE PREFERRED EMBODIMENTS

Figure 4:
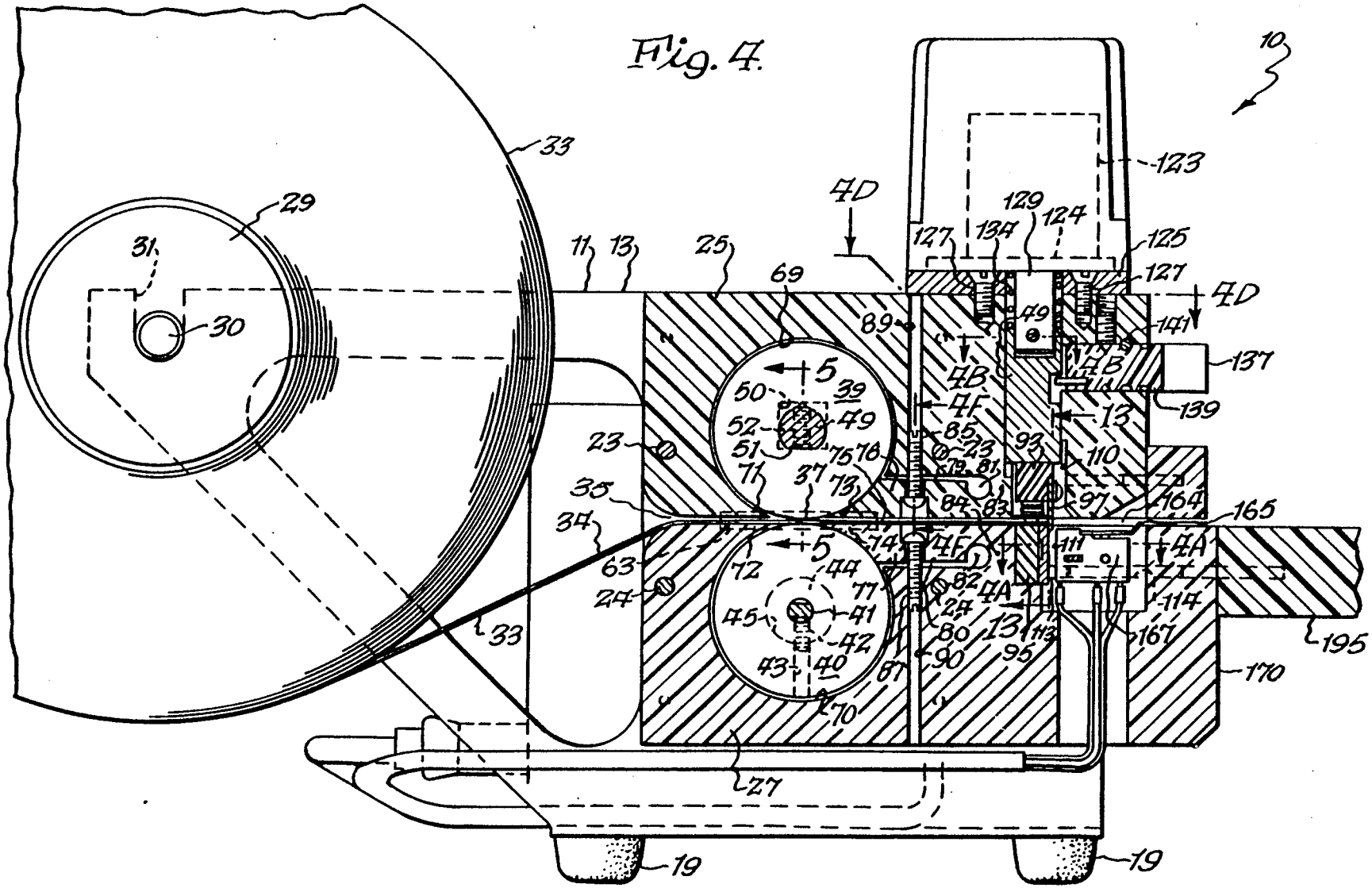
FIG. 4 is an enlarged fragmentary cross sectional view taken substantially along line 4—4 of FIG. 1.

The tape dispensing and cutting machine 10 of the present invention includes mirror image side frame members 11 and 12 having vertical frame sides 13 and 14, respectively, which have integral flanges 15 and 17, respectively, at their lower ends which serve as a base having rubber feet 19 suitably secured to the undersides thereof. A control and motor housing 20 is mounted on bracket 21 which is secured to flange 15 by bolt 22. Frame sides 13 and 14 are secured by screws 23 and 24 to upper and lower nylon spacer blocks 25 and 27, respectively. More specifically, two screws 23 pass through each of frame sides 13 and 14 and enter opposite sides of spacer block 25 and two screws 24 pass through each of frame sides 13 and 14 and enter lower spacer block 27.

A tape roll hub 29 includes a shaft 30 which is rotatably received in cutouts 31 and 32 in frame sides 13 and 14, respectively. A roll of cohesive tape 33 is supported on hub 29, and it has its cohesive side 34 oriented upwardly as shown when it enters tape path 35 between spacer blocks 25 and 27. The tape is thus guided through the space 37 between nip roll 39 and driven roll 40, the shaft 41 of which is suitably coupled to the electric motor 38 within control housing 20. Drive roll 40 is secured to shaft 41 by means of set screw 42 which passes through a radial bore 43 therein. Drive roll 40 has integrally molded hub portions 44 on opposite sides thereof which are received in mating cutouts 45 and 47 in frame sides 13 and 14, respectively.

The nip roll 39 is mounted for movement between a threading position wherein it is spaced away from drive roll 40 and a position wherein it abuts drive roll 40 to cooperate with the latter in feeding the tape 33. The structure for mounting nip roll 39 for the foregoing type of operation includes a shaft 49 (FIGS. 4, 5, 7 and 8) which passes through identical aligned square cutouts 50 in frame sides 13 and 14. Shaft 49 is cylindrical and it includes a flat 51. The diameter of the cylindrical portion of shaft 49 is slightly smaller than the spacing between the opposite sides of square cutout 50 to allow for any misalignment between the frame sides 13 and 14. Spring detent units 52 (FIGS. 5, 7, 8 and 9) are threaded on their outsides and screwed into spaced tapped bores 56 in shaft 49. The balls 53 in spring detents 52 are biased outwardly by springs 54. A collar 55 is mounted on shaft 49 by set screw 57 and it bears against frame side 13. A knob 59 is formed integrally with shaft 49 and it has a collar 60 which effectively bears on frame side 14. Thus collars 55 and 60 align bores 56 of spring detents 52 with frame sides 13 and 14.

When it is desired to move nip roll 39 away from drive roll 40, as when the tape 33 is to be manually threaded therebetween, knob 59 is manipulated to move shaft 49 to the position of FIG. 8 wherein balls 53 do not bear on the upper sides 61 of square cutouts 50. Thus, shaft 49 will have its outer cylindrical portion bearing the lower sides 62 of both square cutouts 50. In this position, nip roll 39 will be spaced from drive roll 40. When knob 59 is manipulated to the vertical position of FIG. 1, shaft 49 will assume the position of FIG. 7 wherein balls 53 bear against upper sides 61 of cutouts 50 to thereby force the shaft 49 downwardly to cause nip roll 39 to move into engagement with drive roll 40 to clamp tape 33 therebetween. The clearance (not numbered) between flat 51 and side 62 permits this to occur. In addition to the foregoing function, the spring biasing function of spring detents 52 also permits nip roll 39 to float toward and away from drive roll 40 as the tape passes therebetween. A pin 64 (FIG. 6) extends outwardly from knob collar 60, and it is used to define the limits of rotary motion of knob 59 by abutting pins 65 and 67 which extend outwardly from frame side 14. Thus, when pin 64 abuts pin 65, shaft 49 will be in the FIG. 7 position, and when it abuts pin 67, shaft 49 will be in the FIG. 8 position. Slot-like cutouts 63 are provided in frame sides 13 and 14 on opposite sides of the nip 37 and the adjacent portions of spacer blocks 25 and 27 to permit viewing of these parts from the opposite sides of the frame.

Nip roll 39 and drive roll 40 fit within substantially cylindrical cutouts 69 and 70, respectively, in spacer blocks 25 and 27, respectively. Entry lips 71 and 72 are formed in blocks 25 and 27, respectively, to guide tape 33 into nip 37. Exit lips 73 and 74 are formed in blocks 25 and 27, respectively, to guide tape 33 into tape path 75 between blocks 25 and 27 after it leaves nip 37. It is important that exit lips 73 and 74 be located very close to the outer peripheries of rolls 39 and 40, respectively, to insure that the free end of the tape passes into the path portion 75 beyond nip 37 rather than passing into the cylindrical spaces between either of the rolls 39 or 40 and its associated spacer block. To this end lips 73 and 74 are adjustable toward their associated rolls. More specifically, lips 73 and 74 are located at the ends of cantilevered portions 76 and 77, respectively, which are bounded by slots 79 and 80, respectively, extending outwardly from cylindrical bores 81 and 82, respectively. Since the blocks 25 and 27 are fabricated from nylon, portions 83 and 84 function as yieldable spring hinges to permit cantilevered portions 76 and 77 to be moved toward and away from their associated rolls. To this end screws 85 and 87 (FIGS. 4 and 4F) are threaded into bores 89 and 90, respectively, to move lips 76 and 77, respectively, toward their associated rolls against the bias provided by hinges 83 and 84, respectively. In this manner the gap between the lips 76 and 77 and their associated rolls can be closed down to lie extremely close to the rolls, but not in touching relationship.

Figure 13:
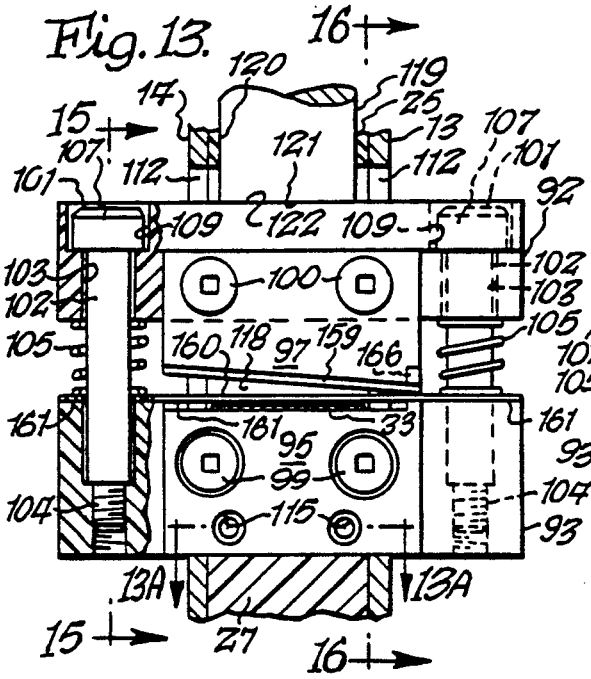
FIG. 13 is a fragmentary cross sectional view taken substantially along line 13—13 of FIG. 4 and showing the guillotine blade subassembly in an open position wherein it permits the threading of the tape therethrough.
Figure 14:
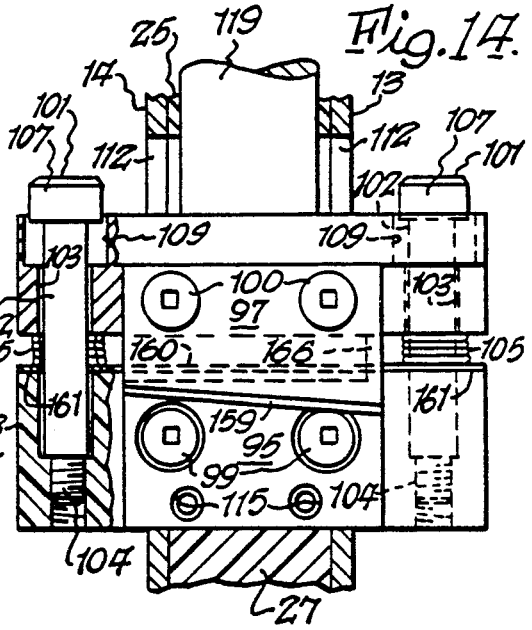
FIG. 14 is a view similar to FIG. 13 but showing the guillotine blade subassembly in a position wherein the movable blade overlies the stationary blade.
Figure 15:
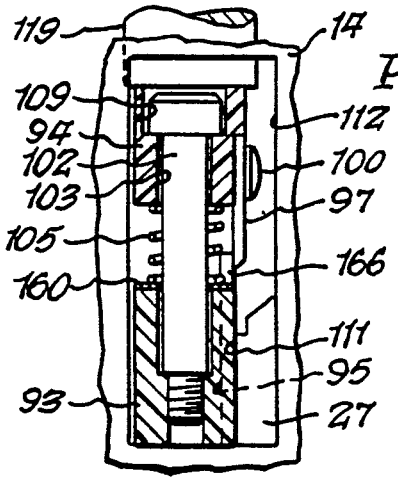
FIG. 15 is a fragmentary cross sectional view taken substantially along line 15—15 of FIG. 13.

The tape 33 which is fed by rolls 39 and 40 is cut by a guillotine-type shear assembly 92 consisting of lower nylon block 93 and upper nylon block 94 mounting lower blade 95 and upper blade 97, respectively, by means of screws 99 and 100, respectively. Blocks 93 and 94 are secured to each other by screws 101 which have upper portions 102 which are slidably received in bores 103 in upper block 94 and which are threadably received at 104 in lower block 93. Springs 105 bias blocks 92 and 93 apart to open blades 95 and 97 to permit tape 33 to pass therethrough (FIG. 13), and springs 105 are compressed when blades 95 and 97 overlap each other (FIG. 14). In the open position of FIG. 13, screw heads 107 are received in bores 109 in upper block 94 and these heads limit the upward movement of upper block 94.

The knife assembly 92 fits in openings 110 and 111 in upper block 25 and lower block 27, respectively, and through openings 112 in frame sides 13 and 14. The knife assembly 92 is retained in position by a pair of set screws 113 which are screwed into bores 114 (FIGS. 4 and 13A) and which bear against depressions 115 (FIGS. 13 and 14) in lower knife blade 95. Bores 114 extend inwardly into block 27 from its outer end face 117.

The normal position of upper blade 97 is as shown in FIGS. 4 and 14 wherein it overlies the upper portion of lower blade 95. A retracting mechanism is provided for selectively retracting upper blade 97 to open the space 118 (FIG. 13) between blades 97 and 95 to permit a tape 33 to be manually threaded therethrough. In this respect, a cylindrical shaft 119 is slidably mounted in bore 120 in upper block 25 and its lower surface 121 bears on the upper surface 122 of upper knife block 94. A solenoid 123 (FIG. 4) has a base 124 which is suitably secured to plate 125 attached to upper block 25 by screws 127. Armature 129 of solenoid 123 is pinned to rod 119 (FIG. 4B) by pin 130 which extands through aligned bores 131 and 132 in shaft 119 and armature 129, respectively. The ends of pin 130 ride in slots 133 in bloc<25 on opposite sides of bore 120 in which shaft 119 slides. Pin 130 thus serves the dual function of attaching armature 129 to shaft 119 and also preventing it from rotating in bore 120. A spring 134 has its upper end bearing on the underside of solenoid mounting plate 124 and its lower end bearing on annular rim 135 of shaft 119 to thereby bias shaft 119 downwardly to cause its lower end to bear on the upper surface 122 of movable knife block 94 and thus cause the guillotine blade 97 to normally occupy the position of FIGS. 4 and 14. In addition, spring 134 biases solenoid armature 129 downwardly because the latter is pinned to shaft 119 by pin 130, as described above.

Figure 10:
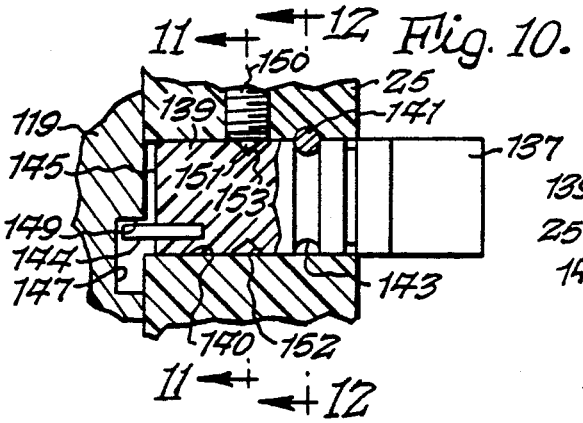
FIG. 10 is an enlarged fragmentary cross sectional view taken substantially along line 10—10 of FIG. 3 and showing the structure for moving the shaft which actuates the movable guillotine blade between operating and retracted positions.
Figure 11:
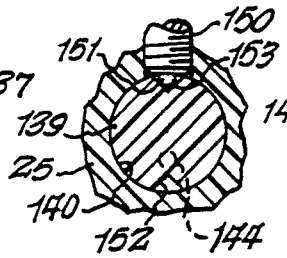
FIG. 11 is a fragmentary cross sectional view taken substantially along line 11—11 of FIG. 10 and showing the detent associated with the structure of FIG. 10.
Figure 12:
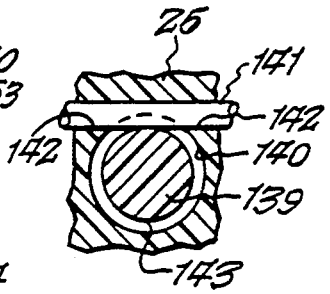
FIG. 12 is a fragmentary cross sectional view taken substantially along line 12—12 of FIG. 10 and showing the structure for retaining the actuating structure in position.

In order to retract shaft 119 against the bias of spring 134, a retracting shaft 139 is provided which has an integrally formed knob 137 (FIG. 10). Shaft 139 is retained within bore 140 within upper block 25 by pin 141 which extends through bores 142 (FIG. 12) in block 25 and is received in annular groove 143 in shaft 139. A pin 144 extends outwardly from the end 145 cf shaft 139, and it is received in slot 147 in slidable shaft 119. In the normal position of FIG. 4 wherein upper blade 97 overlies lower blade 95, as shown in FIG. 14, the upper side 149 of slot 147 will be located proximate pin 144 which is in a lowermost position. Also, in this position the ends of pin 130 will abut the lower ends of slots 133 (FIG. 4C). In order to raise shaft 119 and upper blade 97 so that the latter provides an opening 118 (FIG. 13) to permit the tape 33 to be threaded through this space, knob 137 is rotated 180° to cause pin 144 to raise shaft 119 by bearing on upper slot surface 149. A spring-biased detent member 150 is screwed into upper block 25 and its spring-biased ball 151 will be received in depression 152 when pin 144 is in an elevated position. Normally, however, spring-biased ball 151 resides in depression 153 when pin 144 and shaft 119 are in the position of FIG. 10.

Figure 16:
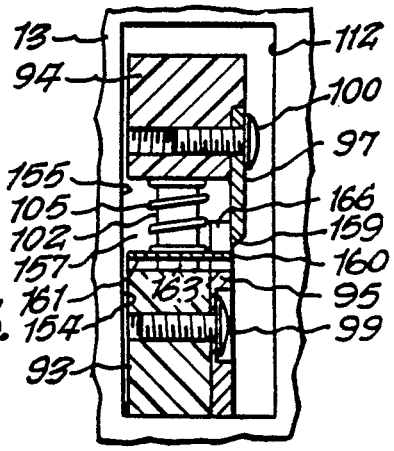
FIG. 16 is a fragmentary cross sectional view taken substantially along line 16—16 of FIG. 13.

As can be seen from FIG. 16, the lower blade is spaced from the side 154 of block 27, and upper knife blade 97 is spaced from the side 155 of upper block 25. Tape path 75 terminates at these sides 154 and 155. Thus, the end of the tape leaving tape path 75 between blocks 25 and 27 must pass through a relatively large distance in upper block 25 before it passes under the edge 159 of movable blade 97. In order to guide the tape through this distance, a plate 160 has opposite end portions 161 (FIG. 13) which lie on the upper surface of lower block 94 and which are biased to this position by springs 105. The underside 161 of plate 160 provides a guide through which the end of tape 33 passes so that t will lie close to the upper cutting edge of lower blade 95. In other words, plate 160 guides the tape through the space 163 (FIG. 16). Plate 161 is positioned slightly above path 75 so that the free end of the tape cannot pass above this plate.

As noted briefly above, when knob 59 is actuated to open the nip between rolls 39 and 40 and when knob 137 is actuated to lift shaft 119, the tape 33 can be threaded through the tape path portion 35, the nip 37, the tape path portion 75 and the opening 118 between the knives. After this has been accomplished, the knob 59 is manipulated to lower nip roll 39 into engagement with the tape, and knob 137 is manipulated to lower shaft 19 so that upper blade 97 cuts the leading end of the tape. This leaves the uncut tape end resting against the side of upper blade 95 which is now in its down position closing opening 118. The portion of tape which has been cut from the end of the roll will now lie in tape path portion 164 where it bears on armature 165 of microswitch 167 (FIGS. 4 and 4A) which is suitably secured within slot 169 in lower spacer block 27.

The operation of the electrical circuit is schematically depicted in FIG. 17. When the armature 165 of microswitch 167 is depressed, the tape advancing and cutting machine 10 is at rest. When the severed end of the tape 169 (FIG. 18) is removed from tape path portion 164, microswitch 165 will be actuated to cause a dual action. First of all, solenoid 123 will be actuated to raise its armature 129 and thus pull shaft 119 attached thereto upwardly against the bias of spring 134. Since pin 44 is now in the position of FIG. 10, slot 147 in shaft 119 will ride upwardly without its lower edge being impeded by pin 144. Accompanying the upward movement of shaft 119, springs 105 will raise upper knife block 92 and knife 97 mounted thereon to open the space 118 between knives 95 and 97. Simultaneously with the obtaining of opening 118, the drive roll motor 38 will be energized to drive roll 40 a predetermined number of degrees to advance the end of tape 33 through opening 118, as determined by the setting of the master timing circuit 166. In this respect, the length of time that the master timing circuit 166 operates can be set by programmable length delay settings $PL_1$, $PL_2$ . . . $PL_n$ to determine the length of tape which is advanced. Upon completion of the operation of motor 38 by the master timing circuit, motor 38 will stop. A fixed delay pulse 168 is then enabled, and thereafter solenoid 123 is deenergized. When solenoid 123 is deenergized, spring 134 will expand to drive shaft 119 downwardly to cause upper knife 97 to move to the position of FIG. 14 against the bias of springs 105 at which time it cuts off the end of the tape which will remain in tape path 164 biasing microswitch armature 165 to a position in which both solenoid 123 and the roll drive motor 38 are both deenergized and which will remain deenergized until the severed end portion 169 of the tape is removed from tape path portion 165. The limit of downward movement of upper knife block 94 is determined by the underside of upper block 94 abutting projection 166 extending upwardly from lower blade 95. A delay circuit 176, which is programmable by programmable off delay settings, $POD_1$, $POD_2$ . . . $POD_n$, is positioned between microswitch 165 and master timing circuit 166 to delay the operation of the master timing circuuit 166 for a predetermined period of time, namely, a few seconds, after the severed end 169 of the tape is withdrawn from overlying relationship to micro-switch 167. This provides time for an operator to manipulate the severed tape end 169, as described hereafter, without intereference from a subsequently severed tape end which extends beyond the end of the machine.

In accordance with another aspect of the present invention, a tube coil wrapping table 195 is provided which has a pair of pins 197 extending outwardly from the end 199 thereof which are received in bores 114 (FIG. 13A) in lower block 27. A leg 200 is located at the outer end of table 195 for resting on the same surface on which feet 19 rest. The cut tape end 169 will extend outwardly beyond the surface 170 of lower block 27 and beyond the surface 176' of block 178 mounted on upper block 25. To wrap a tube coil 202, a side of the tube coil is placed against surface 176' in overlying relationship to the cohesive surface 34 of a central portion of the severed end 169 of the tape. The coil 202 and tape end 169 are then moved together as a unit by an operator to overlie groove 201 in block 195, and the operator will push tape coil 202 and the cut tape 169 into groove 201 which will cause the ends 203 of tape 169 to assume the position of FIG. 18. Thereafter, he will wipe the two tape ends 203 togther with his thumb in the direction of arrow 206, as shown, to assume the position shown in FIG. 19. The tape coil 202 is then removed from groove 201, and it is rotated circumferentially and placed against surface 176' and on top of another severed end 169 of tape which has been automatically produced after the delay provided by delay 176. As noted above, the delay prevents the subsequently severed tape end from interfering with the manipulation of the coil during banding, as described above. The coil and tape end 169 are then manipulated again, as described above, to provide another band 204 which is circumferentially spaced from the previous band 204. The foregoing procedure is repeated to apply another tape attachment 204 to the tube coil until the required number of bands 204 are obtained which will hold the tape coil assembled. The extension 195 car also have another size depression 205 in the opposite side thereof, and the position of depression 205 may be at any suitable Position which will permit bands, such as 204, to be applied in the above described manner. The left side of FIG. 18 is highly schematic and not to scale whereas the portion showing the coil in the groove is more accurate.

While the motor for driving the blade 97 has been shown as being a solenoid 123, it will be appreciated that other types of motors, such as a pneumatic motor comprising a piston and cylinder, may be used, and that such other types of motors are within the scope of the present invention. Furthermore, it will be understood that the cohesive tape is a type of tape wherein its side which is coated with a cohesive coating will only stick to itself and not to foreign bodies, and it is this feature which permits it to pass through the machine 10 without sticking to the internal parts thereof.

While preferred embodiments of the present invention have been disclosed, it will be appreciated that it is not limited thereto but may be otherwise embodied within the scope of the following claims.

What is claimed is:

1. A tape cutting and dispensing machine comprising a frame, first and second frame sides on said frame, first and second spacer blocks having opposite sides, means connecting said first frame said to sides of said first and second spacer blocks, means connecting said second frame side to the opposite sides of said first and second spacer blocks, a tape channel between said first and second spacer blocks, tape roll mounting means for mounting a roll of tape relative to said spacer blocks, first and second recesses in said first and second spacer blocks, respectively, a drive roll, a nip roll, means mounting said drive roll for rotation in said first recess of said first spacer block, a nip roll shaft mounting said nip roll and having opposite ends mounted relative to said first and second frame sides for positioning said nip roll in said second recess of said second spacer block in opposition to said drive roll to define a tape path therebetween in substantial alignment with said tape channel, nip roll moving means for selectively moving said nip roll shaft and said nip roll away from said drive roll to enlarge said tape path for threading said tape therethrough and for moving said nip roll toward said drive roll to clamp said tape therebetween, knife means, means mounting said knife means relative to said frame on an opposite side of said drive roll and said nip roll from said tape roll mounting means, first motor means for selectively actuating said knife means to sever a portion of said tape from said roll, and second motor means for selectively driving said drive roll to advance a portion of said tape through said tape channel.

2. A tape cutting and dispensing machine as set forth in claim 1 wherein said first and second frame sides comprise sheet metal members, and flange means formed integrally with said frame sides for providing a base for said machine.

3. A tape cutting and dispensing machine as set forth in claim 1 wherein said nip roll moving means comprise spring-biased plungers mounted relative to said nip roll shaft, openings in said first and second frame sides, said openings having first edge portions which are relatively close to the axis of said nip roll shaft and second edge portions which are relatively far from said nip roll shaft, and means for selectively rotating said nip roll shaft to cause said spring-biased plungers to selectively either bear on said first edge portions to thereby bias said nip roll more toward said drive roll to thereby feed said tape in conjunction with said drive roll or to be located proximate said second edge portions to enlarge the space between said nip roll and said drive roll to permit said tape to be threaded through said enlarged space therebetween.

4. A tape cutting and dispensing machine as set forth in claim 3 wherein said openings are quadrangular shapes, and wherein said first edge portions are along the sides of said quadrangular shapes.

5. A tape cutting and dispensing machine as set forth in claim 3 wherein said nip roll shaft includes a flat diametrically opposite to said spring-biased plungers to thereby cause the axis of said nip roll shaft to approach the axis of said drive roll shaft when said spring-biased plungers bear on said first edge portions.

6. A tape cutting and dispensing machine as set forth in claim 5 wherein said openings are quadrangular shapes, and wherein said first edge portions are along the sides of said quadrangular shapes.

7. A tape cutting and dispensing machine as set forth in claim 6 including cutouts in said frame sides proximate to the adjacent portions of said nip roll and drive roll.

8. A tape cutting and dispensing machine as set forth in claim 1 including lip means on said second spacer block proximate the space between said nip roll and said second spacer block and on an opposite side thereof from said tape roll mounting means, and means for moving said lip means proximate said nip roll toward said nip roll to adjust the clearance therebetween to prevent the tape from entering the space between said nip roll and said second spacer block during threading of said tape through the path between said nip roll and said drive roll.

9. A tape cutting and dispensing machine as set forth in claim 8 including second lip means on sad first spacer block proximate the space between said nip roll and said drive roll and on the opposite side thereof from said tape roll mounting means, and means for moving said second lip means toward said drive roll to adjust the clearance therebetween to prevent the tape from entering the space between said drive roll and said first spacer block during threading of said tape through the path between said nip roll and said drive roll.

10. A tape cutting and dispensing machine as set forth in claim 8 wherein said lip means and said second lip means comprise flexible extremities on said first and second spacer blocks.

11. A tape cutting and dispensing machine as set forth in claim 8 including second lip means on said first and second spacer blocks between said tape roll mounting means and said nip and drive rolls for guiding said tape into said space between said nip roll and said drive roll.

12. A tape cutting and dispensing machine as set forth in claim 1 wherein said knife means comprise a first knife blade located in said first spacer block, a second knife blade located in said second spacer block.

13. A tape cutting and dispensing machine as set forth in claim 12 wherein said first and second knife blades comprise a guillotine arrangement.

14. A tape cutting and dispensing machine as set forth in claim 13 including means in said second spacer block coupling said second knife blade to said first motor means.

15. A tape cutting and dispensing machine as set forth in claim 12 including guide means between a portion of said second spacer block and said second knife blade for guiding said tape into the space between said first and second knife blades.

16. A tape cutting and dispensing machine as set forth in claim 15 wherein said guide means comprises a plate, and means mounting said guide plate in fixed relationship to said first and second spacer blocks.

17. A tape cutting and dispensing machine as set forth in claim 1 wherein said knife means comprises a first knife member fixedly mounted relative to said first spacer block, a second knife member movably mounted relative to said second spacer block, and wherein said first motor means comprises a solenoid including an armature, and wherein said second knife member is effectively coupled to said armature, and spring means for biasing said armature and said second knife member toward said first knife member to close the space therebetween when said solenoid is not energized.

18. A tape cutting and dispensing machine as set forth in claim 17 including second spring means mounted between said first and second knife members for biasing said second knife member away from said first knife member to open the space therebetween when said solenoid is energized to move said armature against the bias of said spring means.

19. A tape cutting and dispensing machine as set forth in claim 18 including a tape guiding plate fixedly mounted proximate said first knife member for guiding said tape to a contiguous position proximate said first knife member during movement thereof through the space between said first and second knife members.

20. A tape cutting and dispensing machine as set forth in claim 1 wherein said knife means includes a first knife member fixedly mounted relative to said first spacer block, a second knife member movably mounted relative to said second spacer block, and wherein said first motor means comprises a solenoid including an armature effectively coupled to said second knife member, first spring means for biasing said armature to a position wherein it causes said second knife member to close the space between said first knife member and said second knife member when said first solenoid is not actuated, second spring means between said first knife member and said second knife member for opening a space therebetween when said armature is moved away from said first knife member, and knife moving means for selectively moving said armature away from said first knife member against the bias of said first spring means when said solenoid is not actuated to permit said second spring means to move said second knife member away from said first knife member to open the space therebetween.

21. A tape cutting and dispensing machine as set forth in claim 20 wherein said knife moving means comprises, a first shaft, means rotatably mounting said shaft in said second spacer block, a second shaft, means coupling said second shaft to said armature, said second shaft being located between said armature and said second knife member, a pin in said first shaft, an oversized cutout n said second shaft for receiving said pin, an edge on said cutout, said cutout being of a size to permit said second shaft to reciprocate upon actuation of said solenoid without engaging said pin, and said second shaft being positioned relative to said pin when said solenoid is not actuated so that rotation of said first shaft causes said pin to engage said edge of said cutout to move said second shaft in a direction away from said second knife member to permit said second spring means to move said second knife member away from said first knife member.

22. A tape cutting and dispensing machine as set forth in claim 21 wherein said nip roll moving means comprise spring-biased plungers mounted relative to said nip roll shaft, openings in said first and second frame sides, said openings having first edge portions which are relatively close to the axis of said nip roll shaft and second edge portions which are relatively far from said nip roll shaft, and means for selectively rotating said nip roll shaft to cause said spring-biased plungers to selectively either bear on sad first edge portions to thereby bias said nip roll more toward said drive roll to thereby feed said tape in conjunction with said drive roll or to be located proximate said second edge portions to enlarge the space between said nip roll and said drive roll to permit said tape to be threaded through said enlarged space therebetween.

23. A tape cutting and dispensing machine as set forth in claim 22 including lip means on sad second spacer block proximate the space between said nip roll and said second spacer block and on the opposite side thereof from said tape roll mounting means, and means for moving said lip means proximate said nip roll toward said nip roll to adjust the clearance therebetween to prevent the tape from entering the space between said nip roll and said second spacer block during threading of said tape through the path between said nip roll and said drive roll.

24. A tape cutting and dispensing machine as set forth in clam 23 including second lip means on said first spacer block proximate the space between said nip roll and said drive roll and on the opposite side thereof from said tape roll mounting means, and means for moving said second lip means toward said drive roll to adjust the clearance therebetween to prevent the tape from entering the space between said drive roll and said first spacer block during threading of said tape through the path between said nip roll and said drive roll.

25. A tape cutting and dispensing machine as set forth in claim 24 including third lip means on said first and second spacer blocks between said tape roll mounting means and said nip and drive rolls for guiding said tape into said space between said nip roll and said drive roll.

26. A tape cutting and dispensing machine as set forth in claim 3 including lip means on said second spacer block proximate the space between said nip roll and said second spacer block and on the opposite side thereof from said tape roll mounting means, and means for moving said lip means proximate said nip roll toward said nip roll to adjust the clearance therebetween to prevent the tape from entering the space between said nip roll and sad second spacer block during threading of said tape through the path between said nip roll and said drive roll.

27. A tape cutting and dispensing machine as set forth in claim 26 including second lip means on said first spacer block proximate the space between said nip roll and said drive roll and on the opposite side thereof from said tape roll mounting means, and means lor moving said second lip means toward said drive roll to adjust the clearance therebetween to prevent the tape from entering the space between said drive roll and said first spacer block during threading of said tape through the path between said nip roll and said drive roll.

28. A tape cutting and dispensing machine as set forth in claim 27 wherein said knife means comprise a first knife blade located in said first spacer block, a second knife blade located in said second spacer block.

29. A tape cutting and dispensing machine as set forth in claim 28 including guide means between a portion of said second spacer block and said second knife blade for guiding said tape into the space between said first and second knife blades.

30. A tape cutting and dispensing machine as set forth in claim 29 wherein said guide means comprises a plate and means mounting said guide plate in fixed relationship to said first and second spacer blocks.

31. A tape cutting and dispensing machine as set forth in claim 26 wherein said guide means comprises a plate and means mounting said guide plate in fixed relationship to said first and second spacer blocks.

32. A tape cutting and dispensing machine comprising a frame, first and second sheet-like frame sides on said frame, first and second spacer blocks having opposite sides, means connecting said first sheet-like frame said to sides of said first and second spacer blocks, means connecting said second frame side to the opposite sides of said first and second spacer blocks, a tape channel between said first and second spacer blocks, tape roll mounting means for mounting a roll of tape relative to said spacer blocks, first and second recesses in said first and second spacer blocks, respectively, a drive roll, a nip roll, means mounting said drive roll for rotation in said first recess of said first spacer block, a nip roll shaft mounting said nip roll and having opposite ends mounted relative to said first and second frame sides for positioning said nip roll in sad second recess of said second spacer block in opposition to said drive roll to define a tape path therebetween in substantial alignment with said tape channel, knife means, means mounting said knife means relative to said frame on an opposite side of said drive roll and said nip roll from said tape roll mounting means, first motor means for selectively actuating said knife means to sever a portion of said tape from said roll, and second motor means for selectively driving said drive roll to advance a portion of said tape through said tape channel.

33. A tape cutting and dispensing machine as set forth in claim 32 including lip means on said second spacer block proximate the space between sad nip roll and said second spacer block and on an opposite side thereof from said tape roll mounting means, and means for moving said lip means proximate said nip roll toward said nip roll to adjust the clearance therebetween to prevent the tape from entering the space between said nip roll and said second spacer block during threading of said tape through the path between said nip roll and said drive roll.

34. A tape cutting and dispensing machine as set forth in claim 33 wherein said knife means comprise a first knife blade located in said first spacer block, a second knife blade located in said second spacer block.

35. A tape cutting and dispensing machine as set forth in claim 34 including guide means between a portion of said second spacer block and said second knife blade for guiding said tape into the space between said first and second knife blades.

36. A tape cutting and dispensing machine as set forth in claim 34 wherein said second knife blade normally overlies said first knife blade to close the space therebetween, and manually actuatable means for selectively retracting said second knife blade away from said first knife blade to open the space therebetween.

* * * * *

UNITED STATES PATENT AND TRADEMARK OFFICE

CERTIFICATE OF CORRECTION

PATENT NO. : 5,063,803

DATED : November 12, 1991

INVENTOR(S) : Alfred J. Panneri et al

It is certified that error appears in the above-identified patent and that said Letters Patent is hereby corrected as shown below:

Column 5, line 34, change "bloc<" to --block--.

Column 5, line 54, change "cf" to --of--.

Column 6, line 16, change "t" to --it--.

Column 7, line 54, change "car" to --can--.

Column 7, line 57, change "Position" to --position--.

Column 10, line 65 (claim 22), change "sad" to --said--.

Column 11, line 5 (claim 23), change "sad" to --said--.

Column 11, line 39 (claim 26), change "sad" to --said--.

Column 12, line 24 (claim 32), change "sad" to --said--.

Column 12, line 37 (claim 33), change "sad" to --said--.

Signed and Sealed this

Thirtieth Day of March, 1993

*Attest:*

STEPHEN G. KUNIN

*Attesting Officer*

*Acting Commissioner of Patents and Trademarks*